United States Patent [19]

Hirashiba et al.

[11] Patent Number: 4,829,606

[45] Date of Patent: May 16, 1989

[54] WASHING DEVICE FOR PARTS OF HUMAN BODY

[75] Inventors: Yuji Hirashiba, Anjo; Mikio Yoshihara, Kariya, both of Japan

[73] Assignee: Aisin Seiki Kabushiki Kaisha, Aichi, Japan

[21] Appl. No.: 906,070

[22] Filed: Sep. 12, 1986

[30] Foreign Application Priority Data

Sep. 13, 1985 [JP] Japan ..... 60-141314

[51] Int. Cl.[4] ..... E03D 11/02

[52] U.S. Cl. ..... 4/420.4

[58] Field of Search ..... 4/420.1, 420.2, 420.4, 4/420.5, 443, 447, 448

[56] References Cited

U.S. PATENT DOCUMENTS

| | | | |
|---|---|---|---|
| 3,662,407 | 5/1972 | Colucci | 4/448 X |
| 3,947,899 | 4/1976 | Robinson et al. | 4/420.2 X |
| 4,393,525 | 7/1983 | Kondo | 4/420.2 |
| 4,451,942 | 6/1984 | Hirano et al. | 4/420.4 X |
| 4,597,111 | 7/1986 | Hirashiba et al. | 4/420.4 |

*Primary Examiner*—Charles E. Phillips
*Attorney, Agent, or Firm*—Sughrue, Mion, Zinn, Macpeak & Seas

[57] ABSTRACT

A washing device for parts of human body for use in a flush toilet which includes essentially a cylinder, a shaft and a water tank. The cylinder has a water supplying orifice and incorporates the shaft in the bore formed therein. The shaft comprises a shaft body and a control axis which is coaxially mounted in the bore of the shaft body. The shaft body has, at one end, a water spouting nozzle and an inflow orifice communicating a water passage to the water inlet port of the cylinder, and has, at the other end, a lever to rotate the whole shaft body. By operation of the lever, water spouting nozzle is movable to or from its inoperative rest position. An amount of washing water to be spouted is controlled by adjusting a sectional area of the water passage. This adjustment is effected by axial movement of the control axis which is provided with a tapered valve portion at one end and is provided with one operating knob at the other end thereof. The knob protrudes from one extremity of the shaft body.

4 Claims, 3 Drawing Sheets

310
210
312
323
313
315
311
321
31
32
30
324
316
314
322

210
312
313
311
31
32
30
315
314

311
31
210
312
313a
313b
32
315
30

WASHING DEVICE FOR PARTS OF HUMAN BODY

BACKGROUND OF THE INVENTION

1. Field of the Invention

This invention relates to a washing device for parts of human body, which is to be used in a flush toilet (hereinafter, it will be merely called "a washing device").

2. Discussion of the Background

In recent years, the aforesaid washing device has been appreciated on its utility value in a sanitary point of view and great number of washing devices have been widely used.

In the conventional washing devices, it is known that when a lever attached to the toilet is operated, a spout pipe having a nozzle at the distal end thereof is movable to and from an inoperative rest position. When the spout pipe is moved to its operative position, a water inlet port communicates with an inflow orifice and an amount of water flowing to a water spouting nozzle is regulated through a needle valve by rotating an adjustment knob.

As shown in FIGS. 6 7 and 8, one type of this known washing device comprises a cylinder B having a water inlet port A, a water spouting nozzle C communicating with an inflow orifice D which in turn communicates with the water inlet port A, a water passage E connecting the water spouting nozzle C to the inflow orifice D, a rotatable shaft G provided with an operating lever F at one end thereof, and the inflow orifice D and the water spouting nozzle C at the other end thereof, and a needle valve J disposed in a water supplying pathway communicating with the water inlet port A to a water tank H.

According to this known washing device, when it is in use, the lever F is operated to rotate the shaft G in the cylinder B. Simultaneously with this operation, the water spouting nozzle C is moved to its operative position within bowl of the flush toilet (as shown in a solid line in FIG. 6) from the inoperative rest position (as shown by double dotted line in FIG. 6), and the water inlet port A is aligned with the inflow orifice D, resulting in jetting water from the water spouting nozzle C.

At the same time, the needle valve J actuates to regulate the amount of water flowing to the water spouting nozzle C in the water supplying pathway I communicating with the water inlet port A. At this point, it is to be noted that a control spindle J1 of the needle valve J is arranged to pass through a top cover K for protecting electrical parts built in the washing device. On the top of the control spindle J1, an adjustment knob is fixedly attached.

This known washing device, however, has the following disadvantages. The needle valve J is arranged to be vertical for up and down movement, so that the control spindle J1 of the needle valve J passes through the protective cover K and protrudes from the top surface thereof. With this construction, there is inevitably created some clearance between the cover K and the control spindle J1 of the needle valve J. For example, when cleaning the flush toilet, water or cleanser may penetrate inside the cover K through the clearance. If electrical parts are flooded, they will corrode, resulting in an electrical hazard such as current leakage. The clearance becomes larger as the needle valve J is opened, and it becomes maximum when the needle valve J is opened in its full extent. (At this time, the adjustment knob is at the highest position.)

SUMMARY OF THE INVENTION

Accordingly, it is an object of the present invention to provide a new washing device which is free from the disadvantages of the prior art and has advantageous features not possessed by known washing devices.

It is another object of the present invention to provide a new washing device of the type wherein the amount of water flowing to the water spouting nozzle may be regulated by varying a sectional area of a water passage by means of a valve portion of a control spindle.

It is a further object of the present invention to construct a protection cover for electrical parts liquid tightly.

It is a still further object of the present invention to provide a new washing device wherein the control spindle is coaxially built in a rotatable shaft, resulting in decrease of the number of constructive parts required.

It is an additional object of the present invention to provide a new washing device which is suitable for mass production.

According to the present invention, a washing device comprises essentially a cylinder, a rotatable shaft and a water tank.

The cylinder is secured to the water tank which in turn is mounted on a toilet bowl. A shaft body (which will be explained hereinafter) is inserted in the cylinder and supported rotatably thereby. A water inlet port is formed in a portion of the cylinder for introducing water from the water tank to a water passage. To carry out the supply of pressurized water, a pump is provided in association with the water tank.

The rotatable shaft comprises the shaft body and a control axis. One end portion of the shaft body has a water spouting nozzle, the water passage communicating with the water spouting nozzle, and an inflow orifice communicating the water passage to the water inlet port formed in the cylinder, while the other end portion of the shaft body has a lever to rotate the whole shaft body.

A locating member is provided to define two positions of the shaft body. At one of these two positions, the water spouting nozzle is moved to an operative position to jet pressured water and at the other position, it is moved to an inoperative rest position.

When the water spouting nozzle is located in an operative position, the inflow orifice is aligned with the water inlet port, while when the water spouting nozzle is in an inoperative position, the inflow orifice does not communicate with the water inlet port, thereby preventing washing water from flowing into the water spouting nozzle.

The inflow orifice may be an axially extended groove with a hole communicating with the groove, or may be constructed only by the hole. The control spindle is supported in a through hole formed in the shaft body so that it may move with regard to the shaft body. The control spindle functions to adjust an amount of washing water to be spouted from the water spouting nozzle by controlling a sectional area of the water passage.

One end of the control spindle functions as a valve to adjust the sectional area of the water passage, while the other end thereof constitutes an operating member which protrudes from the shaft.

The valve may have a tapered configuration, and it is desirable that a valve seat which faces the tapered valve be formed in the water passage.

It is to be appreciated that a sealing member surrounding protruded portions of the shaft and the control spindle axis may be provided to make them water tightly. No leakage of washing water from the washing device should be allowed.

The control spindle may be screwed in the shaft body. This construction allows the control spindle to advance or to go back by rotating it clockwise or counterclockwise. Another solution is to construct the control spindle such that when the spindle is axially pushed in, it advances, while when the spindle is pulled out, it goes back.

By virtue of this arrangement, when the user rotates the lever, the water spouting nozzle is moved to an operative position. Simultaneously with this movement, the inflow orifice of the shaft body communicates with the water inlet port of the cylinder, and pressurized water is introduced to the water passage through the inlet port and the orifice.

At this point, it is noted that an amount of washing water flowing into the water passage is adjusted by changing the sectional area of the water passage through a manual operation of the control spindle. That is, a supply amount of pressurized water can be controlled at a distance from the protected cover for electrical parts. The user can control the supply amount of washing water at his option by the knob located at hand.

As aforementioned, according to the present invention, it is possible to control the supply amount of washing water by simply adjusting the sectional area of the water passage to the water spouting nozzle. Such control of the amount of water is achieved by an action of the valve formed at the front end of the control spindle in the shaft body, instead of conventional needle valve constructions.

That is, there is not required to provide a vertical control spindle (needle-valve) protruding from the top cover of the washing device. Therefore, as compared with the conventional construction, the top cover enclosing electrical parts is sealed liquid tightly, and there is no possibility of an electrical hazard during or after cleaning the fluid toilet.

It is possible to construct the control axis and the shaft body as a unit, resulting in decrease of time and cost for assemblage and thus to provide the washing device which is suitable for mass production.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENTS EMBODIMENT 1

Figure 1:
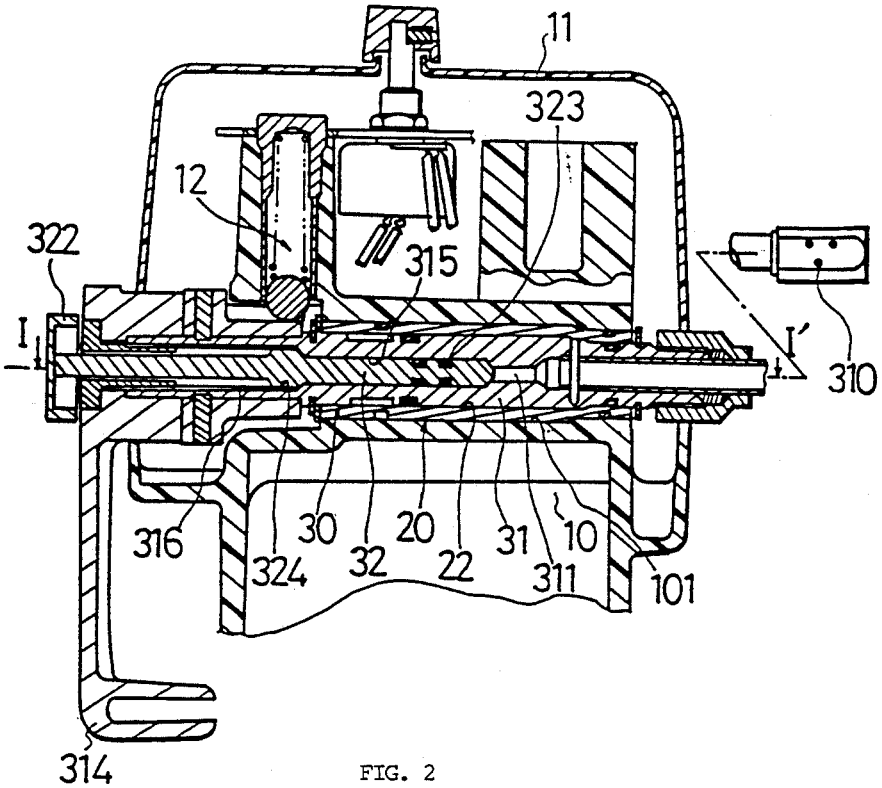
FIG. 1 is a fragmentary sectional view showing on an enlarged scale essential components of the present invention according to a first embodiment.
Figure 2:
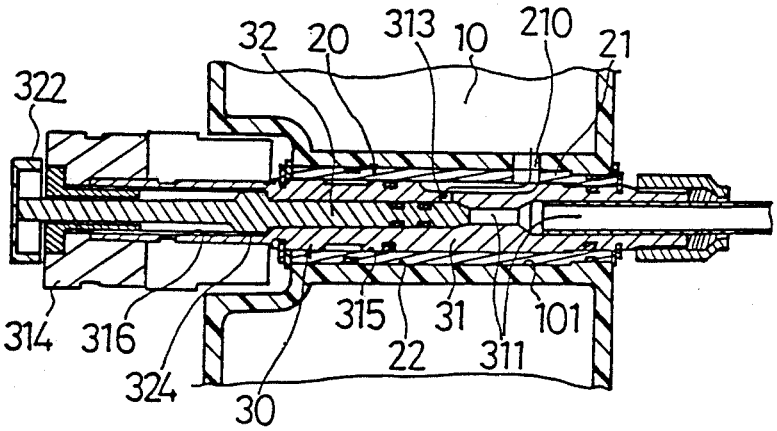
FIG. 2 is a sectional plan view taken a line I—I' in FIG. 1.
Figures 3, 4, 5:
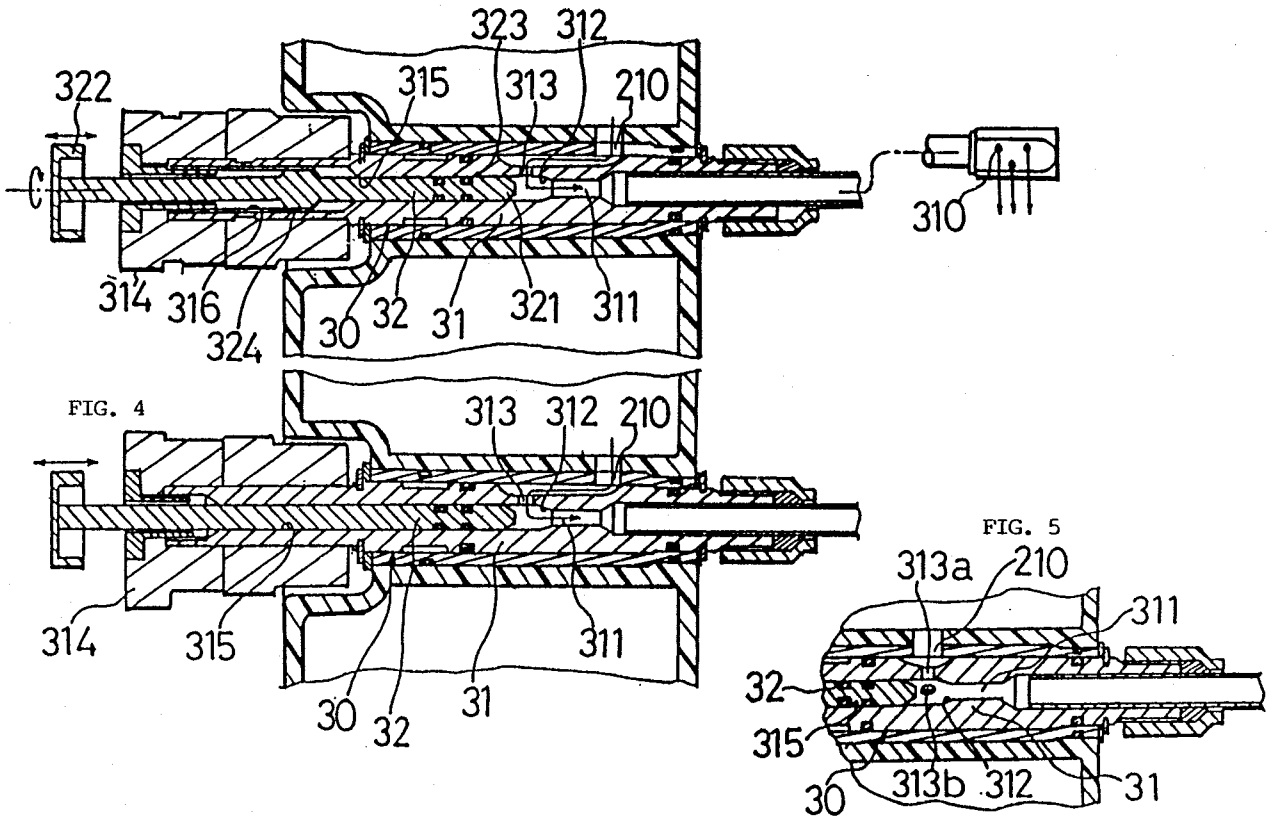
FIG. 3 is a fragmentary section as enlarged of the operated condition of the supply of water controlling arrangement shown in FIG. 2.
FIG. 4 is a fragmentary sectional view showing on an enlarged scale the shaft, the control axis and th associated parts according to a second embodiment of the present invention.
FIG. 5 is a fragmentary sectional view showing on an enlarged scale essential components of the present invention according to a third embodiment.
Figure 7:
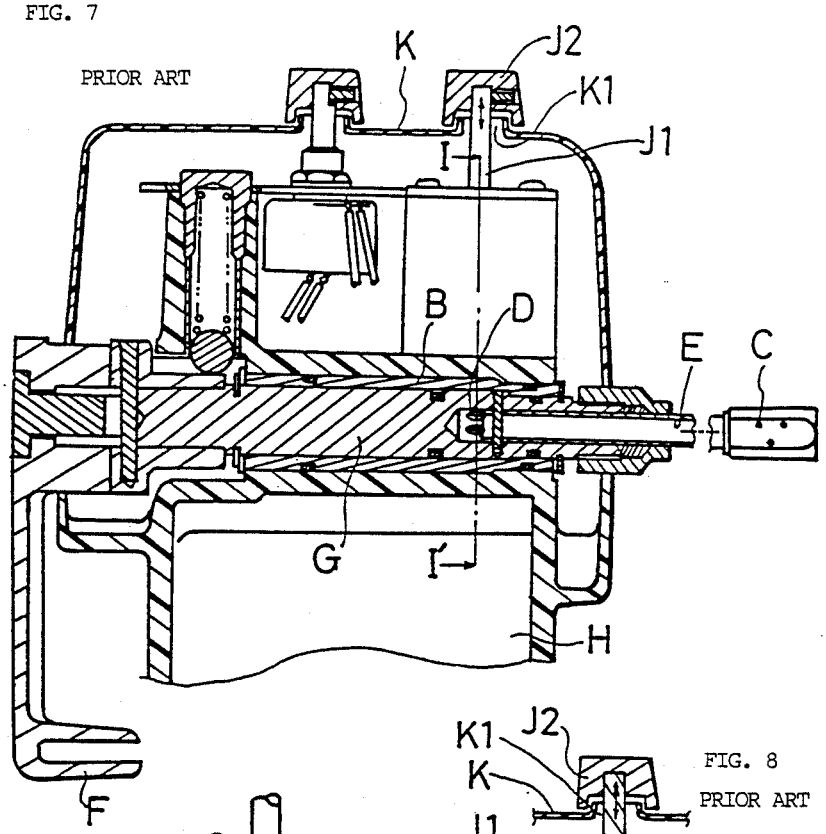
FIG. 7 PRIOR ART
FIG. 7 is a fragmentary sectional view showing on an enlarged scale essential components of the conventional washing device.
Figure 6:
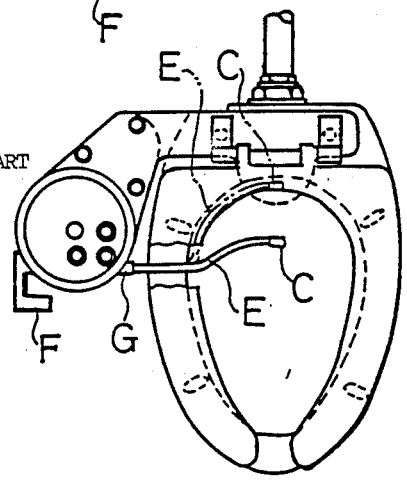
FIG. 6 PRIOR ART
FIG. 6 is a plan view showing a flush toilet incorporating a conventional washing device.
Figure 8:
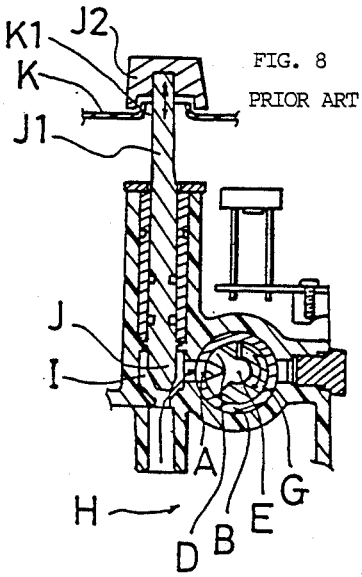
FIG. 8 PRIOR ART
FIG. 8 is a fragmentary sectional view showing on an enlarged scale the needle-valve and the associated parts of the conventional washing device.

Referring to the accompanying drawings, FIGS. 1 to 3, the washing device of this first embodiment comprises essentially a water tank 10, a cylinder 20 and a shaft 30.

The gist of this first embodiment resides in the construction of the shaft 30. The water tank 10 is a reservation of a predetermined amount of washing water. Integrally connected to the water tank 10 are various electric parts required for the washing device of this embodiment, a device for heating water, a pump for pressurizing water, etc.

A cover 11 is provided to protect electric parts and other materials from an environmental influence.

Secured to the water tank 10 is a cylinder 20 (which will be explained hereinafter) in which a shaft 30 is supported rotatably.

Also secured to the water tank is a locating member for defining rotational positions of the shaft 30. The cylinder 20 has a water inlet port 210 and is fixedly inserted in a bore 101. A shaft body 31 (which will be explained hereinafter) is supported in an axial through hole 22 formed in the cylinder 20.

The water inlet port 210 functions to supply pressurized water through the pump from the water tank 10 to a water passage 311 formed in the shaft body 31. The shaft 30 consists of the shaft body 31 and a control spindle 32.

Provided at one end of the shaft body 31 are a water spouting nozzle 310, the water passage 311 communicating with the water spouting nozzle 310, and an inflow orifice 313 communicating the water passage 311 to the water inlet port 210 in the cylinder 20. The shaft body 31 has at the other end, a lever 314 to rotate the whole shaft body 31.

The shaft body 31 is held at a water spouting position and at a water shutting off position by means of the locating member 12.

When the shaft body 31 is held at the water spouting position, the inflow orifice 313 communicates with the water inlet port 210 of the cylinder 20, when the shaft body 21 is held at the water shutting off position, the inflow orifice 313 does not communicate with the water inlet port 210.

The control spindle 32 is inserted in an axial through hole 315 formed in the shaft body 31 and relatively rotatable with regard to the shaft body 310. A portion of the outer surface of the control spindle 32 has a male screw 324 which engages with a female screw 316 formed on a portion of the through hole 315.

As will be detailed below, the control spindle 32 functions to control the sectional area of the water passage 311 for regulating the amount of water supply to be ejected from the water spouting nozzle 310. That is, one end of the control spindle 32 constitutes a valve 321 having a tapered configuration, while the other end of the spindle 32 protrudes from the end surface of the shaft 30 and constitutes an operating knob 322.

A valve seat 312 corresponding with the tapered portion of the valve 321 is formed in the water passage 311. The control spindle is provided with seal members 323 which come in close contact with the inner surface of the through hole 315 to insure air-tightness.

Next, the operation of this washing device will be explained. If the user rotates the shaft 30 by operating the lever 314, the water spouting nozzle 310 is moved to its advanced operative position. Simultaneously with this movement of the nozzle 310, the inflow orifice 313 of the shaft body 31 comes to align the water inlet port 210 of the cylinder 20, and then, a heated water or water of normal temperature is introduced to the water passage 311 through the water inlet port 210 and the inflow orifice 313. The amount of water flowing into the water passage 311 is controlled by adjusting the sectional area of the passage 311. This adjustment of the sectional area of the passage 311 is carried out by manually operating the knob 322, so that the control spindle 32 with a valve portion 321 is displaced.

Thus, a controlled amount of water jets from the water spouting nozzle 310. According to this mechanism, the user can control the amount of spouting water at his option simply by operating the near knob which is located apart away from the cover 11.

EMBODIMENT 2

Hereinafter, a second embodiment according to the present invention will the explained.

A washing device according to this second embodiment in shown in FIG. 4 wherein a shaft, a control spindle and the associated parts of this device are illustrated in a fragmentary sectional view. The gist of this second embodiment resides in that the control spindle 32 with a valve portion 321 is moved to adjust the sectional area of a water passage 311 by axially pushing in or pulling out a knob 322, instead of turning it clockwise or counterclockwise.

EMBODIMENT 3

Hereinafter, a third embodiment according to the present invention will be explained.

A washing device according to this third embodiment is shown in FIG. 5. A shaft body 31 is formed with a plurality of inflow orifices 313*a* and 313*b* each of which has a diameter different from each other. By operating the lever 314, either one of these two inflow orifices 313*a* and 313*b* comes to align the water inlet port 210 of the cylinder 20.

Each of inflow orifices 313*a* and 313*b* corresponds with anus - or bidet - washing. If the user communicates the inlet port 313*a* having a larger diameter to the water inlet port 210, a larger amount of water is spouted for anus-washing. If the inflow orifice 313*b* with a smaller diameter is set to communicate with the inlet port 210, bidet-washing is effected. Although the invention has been described in its preferable form with a certain degree of particularly it is to be understood that many changes and variations are possible in the invention without departing from its scope, and spirit thereof.

What is claimed as new and desired to be secured by letters patent of the United States is:

1. A washing device for use with a toilet bowl comprising:

a tank adapted to be mounted adjacent said toilet bowl for storing washing water;

a cylinder mounted inside the tank having a radially disposed water inlet port for receiving said washing water;

a shaft body rotatably mounted inside said cylinder;

nozzle means connected to one end portion of said shaft body;

a lever connected to an opposite end portion of said shaft body for rotating said shaft body within said cylinder;

an axial through-hole provided inside said shaft body;

a radial inflow orifice provided in said shaft body in communication with said axial through-hole whereby upon rotation of said shaft body by said lever, said radial inflow orifice is movable into and out of fluid communication with said radial inlet port of said cylinder;

water control means including a control spindle threadedly mounted in said axial through-hole so as to control the flow of water from said radial inflow orifice into said axial through-hole; and an operating knob connected to an end portion of said control spindle adjacent said lever for moving said control spindle in the axial direction of said axial through-hole.

2. A washing device as set forth in claim 1 wherein said control spindle has a tapered end opposite said operating knob and said shaft body is provided with a tapered valve seat about said axial through-hole between said radial inflow orifice and said nozzle means for engagement by said tapered end of said spindle.

3. A washing device as set forth in claim 1 further comprising sealing means associated with said cylinder and said control spindle between said tapered end of said spindle and said operating knob.

4. A washing device as set forth in claim 1 further comprising a pump disposed in said tank for delivering said washing water under pressure to said radial inflow orifice of said shaft body;

an electric unit disposed on an upper portion of said tank for controlling said pump; and waterproof covering means on said tank for covering said electric unit.

* * * * *